US009439461B1

(12) United States Patent
Hall et al.

(10) Patent No.: US 9,439,461 B1
(45) Date of Patent: Sep. 13, 2016

(54) FINGER PROTECTING DEVICE

(71) Applicants: Arvetta Hall, Bowling Green, KY (US); Shanekia Hall, Bowling Green, KY (US)

(72) Inventors: Arvetta Hall, Bowling Green, KY (US); Shanekia Hall, Bowling Green, KY (US)

( * ) Notice: Subject to any disclaimer, the term of this patent is extended or adjusted under 35 U.S.C. 154(b) by 376 days.

(21) Appl. No.: 14/028,028

(22) Filed: Sep. 16, 2013

(51) Int. Cl.
*A41D 13/08* (2006.01)
*A63B 71/14* (2006.01)
*A45D 29/00* (2006.01)

(52) U.S. Cl.
CPC ..... *A41D 13/087* (2013.01); *A63B 71/14* (2013.01); *A45D 2029/008* (2013.01)

(58) Field of Classification Search
CPC ..... A45D 2029/008; A63B 71/14; A41D 13/087
USPC ..... 2/16, 20, 21, 163
See application file for complete search history.

(56) References Cited

U.S. PATENT DOCUMENTS 2,467,613 A * 4/1949 Davis ..... A41D 13/087 2/21
3,728,736 A * 4/1973 Pugh ..... A41D 13/087 2/21
4,751,747 A 6/1988 Banks et al.
4,881,275 A * 11/1989 Cazares ..... A63B 71/148 2/161.1
D351,930 S 10/1994 Snider et al.
5,450,626 A * 9/1995 Sorrels ..... A41D 19/01517 2/163
6,009,557 A 1/2000 Witta
6,101,628 A * 8/2000 Earl ..... A41D 13/087 2/16
6,209,137 B1 4/2001 Wallick
6,302,116 B1 * 10/2001 Copeland ..... A45D 29/00 132/73
6,363,536 B1 * 4/2002 Sloan ..... A41D 19/0051 2/163
D583,104 S 12/2008 Stewart
2008/0235843 A1 10/2008 Stinchcomb
2012/0011634 A1 1/2012 Pelinsky

* cited by examiner

*Primary Examiner* — Katherine Moran

(57) ABSTRACT

A finger protecting device protects fingertips of a user from soreness and supports a wrist of the user while knitting. The device includes a band configured for positioning around a wrist of a user. A pair of finger guards is provided. Each of the finger guards has a top edge and a perimeter wall extending downwardly from the top edge. Each of the top edges and the perimeter walls define an interior space of the finger guards wherein the finger guards are configured for positioning over a thumb and an index finger of the user. A pair of straps is provided. Each of the straps couples the band to an associated one of the finger guards.

18 Claims, 3 Drawing Sheets

FINGER PROTECTING DEVICE

BACKGROUND OF THE DISCLOSURE

1. Field of the Disclosure

The disclosure relates to protecting devices and more particularly pertains to a new protecting device for protecting fingertips of a user from soreness and supporting a wrist of the user while knitting.

2. Summary of the Disclosure

An embodiment of the disclosure meets the needs presented above by generally comprising a band and a pair of finger guards. Each of the finger guards has a top edge and a perimeter wall extending downwardly from the top edge. Each of the top edges and the perimeter walls define an interior space of the finger guards wherein the finger guards are configured for positioning over a thumb and an index finger of the user. A pair of straps is provided. Each of the straps couples the band to an associated one of the finger guards.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
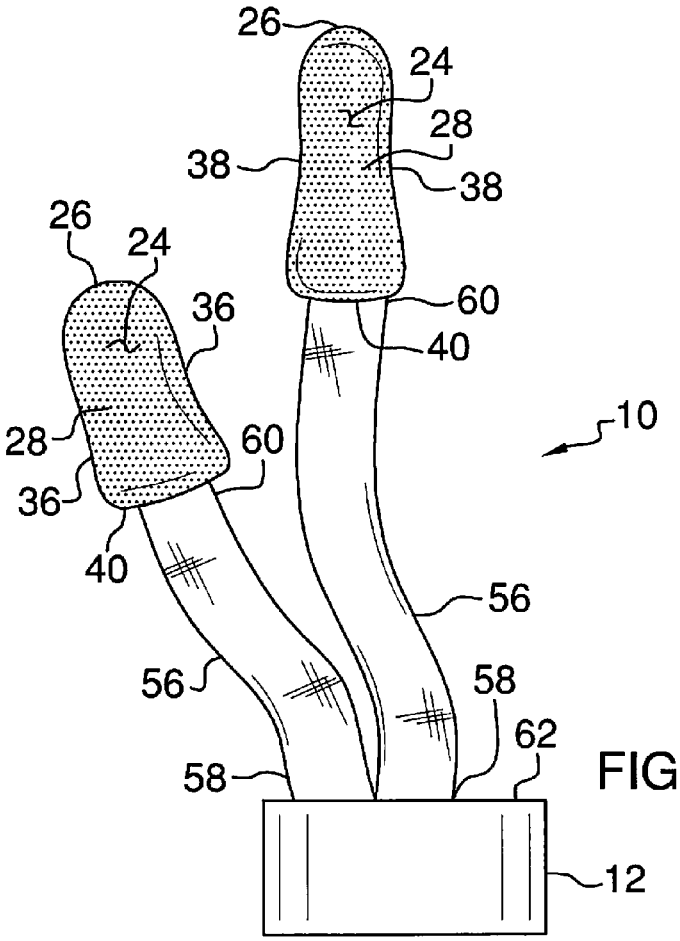
FIG. 1 is a side view of a finger protecting device according to an embodiment of the disclosure.
Figure 2:
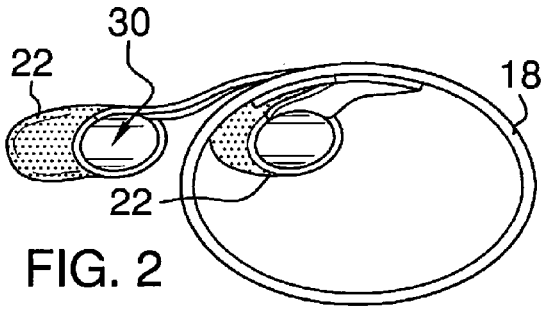
FIG. 2 is a back view of an embodiment of the disclosure.
Figure 3:
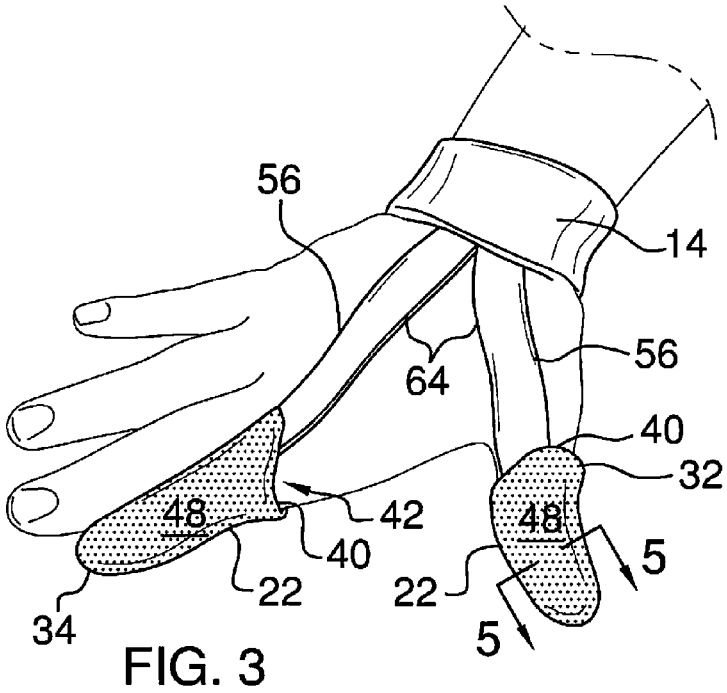
FIG. 3 is an in-use top perspective view of an embodiment of the disclosure.
Figure 4:
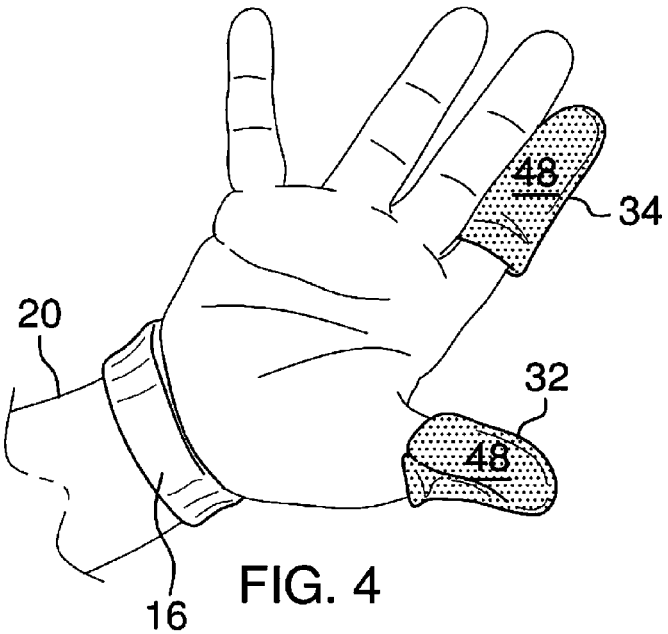
FIG. 4 is an in-use bottom view of an embodiment of the disclosure.
Figure 5:
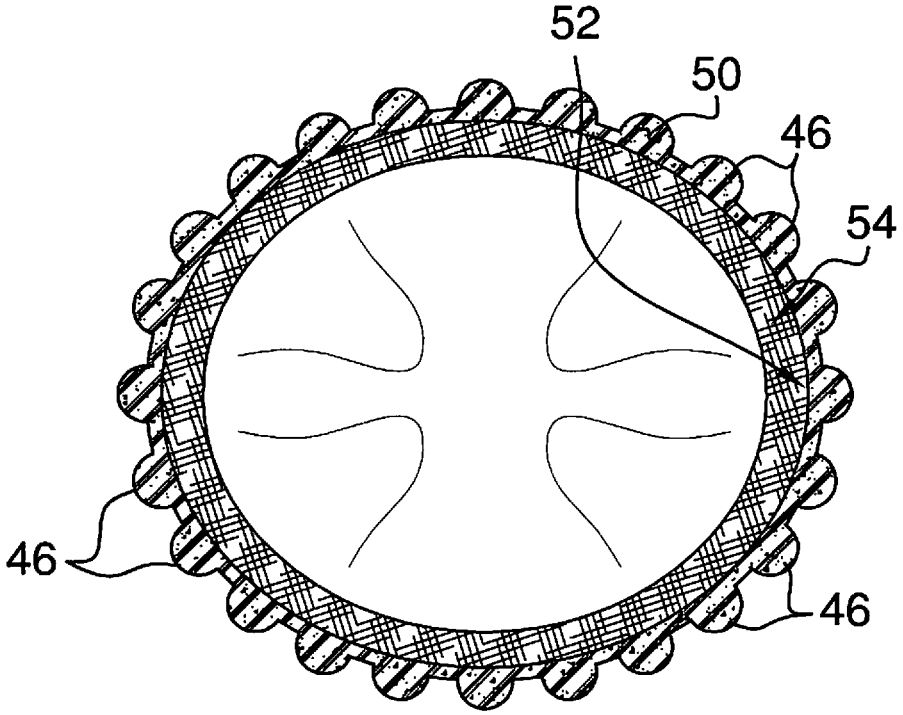
FIG. 5 is a cross-sectional view of an embodiment of the disclosure taken along line 5-5 of FIG. 3.

With reference now to the drawings, and in particular to FIGS. 1 through 5 thereof, a new protecting device embodying the principles and concepts of an embodiment of the disclosure and generally designated by the reference numeral 10 will be described.

As best illustrated in FIGS. 1 through 5, the finger protecting device 10 generally comprises a band 12 having a top side 14, a bottom side 16, and a peripheral wall 18 extending between the top side 14 and the bottom side 16. The band 12 is configured for positioning around a wrist 20 of a user. The band 12 may be comprised of an elastomeric material.

A pair of finger guards 22 is provided. The finger guards 22 may be comprised of a resiliently compressible material 24, such as rubber, wherein the finger guards 22 are stretchable. Each of the finger guards 22 has a top edge 26 and a perimeter wall 28 extending downwardly from the top edge 26. Each of the top edges 26 and the perimeter walls 28 define an interior space 30 of the finger guard 22. The finger guards 22 comprise a first finger guard 32 and a second finger guard 34 wherein the first finger guard 32 is configured for positioning over a thumb of the user and the second finger guard 34 is configured for positioning over an index finger of the user. Thus, the finger guards 32 protect the user's thumb and index finger against fingertip soreness while the user is knitting, crocheting, or the like. A distance between lateral sides 36 of the first finger guard 32 is preferably greater than a distance between lateral sides 38 of the second finger guard 34. Each of the top edges 26 of the finger guards 22 is preferably arcuate. A bottom edge 40 of each of the finger guards 22 defines an access opening 42 into the interior space 30 of the finger guards 22. A distance between the top edge 26 and the bottom edge 40 of the first finger guard 32 is preferably smaller than a distance between the top edge 26 and the bottom edge 40 of the second finger guard 34. Each of the finger guards 22 may be concavely arcuate between an associated one of the top 26 and bottom 40 edges.

A plurality of raised bumps 46 may be positioned on the finger guards 22 and positioned on an exterior surface 48 of the finger guards 22. The raised bumps 46 are preferably spaced and may be positioned uniformly across the exterior surface 48 of the finger guards 22 between the top 26 and bottom 40 edges of each of an associated one of the finger guards 22. The raised bumps 46 may be comprised of a resiliently compressible material 50, such as rubber, wherein the raised bumps 46 are configured to facilitate gripping with the finger guards 22. An inner surface 52 of the finger guards 22 may be lined with a first material 54. The first material 54 is preferably a fleece fabric.

A pair of straps 56 is provided. Each of the straps 56 couples the band 12 to an associated one of the finger guards 22. The straps 56 may be sewn to the finger guards 22. The straps 56 may be comprised of an elastomeric material. The straps 56 extend outwardly from the top side 14 of the band 12. Each of the straps 56 has a first end 58 and a second end 60. The first ends 58 of the straps 56 may be coupled to a lower edge 62 of the band 12. The second ends 60 of the straps 56 may be coupled to the bottom edge 40 of an associated one of the finger guards 22. The straps 56 preferably abut each other at an inner edge 64 of each of the straps 56 and extend away from each other to form a v-shape when the band is worn on the user's wrist 20 and the user's thumb and index forger are positioned in the finger guards 22. The strap 56 coupling the band 12 to the first finger guard 32 is preferably shorter in length than the strap 56 coupling the band 12 to the second finger guard 34. A heating pad can be heated and positioned beneath the straps 56 such that the heating pad abuts a back side of a hand of the user. Thus, the straps 56 are able to support the heating pad while the user is knitting. In this manner, a user's hand can be heated while the user is knitting to provide comfort for a longer knitting time.

In use, as stated above and shown in the Figures, the band 12 is positioned around the wrist 20 of the user and the thumb and index finger of the user are inserted into the associated one of the finger guards 22. The raised bumps 46 facilitate gripping with the finger guards 22 while the user is knitting. A heating pad can be heated and positioned between the straps 56 and a back side of a hand of the user such that the heating pad is retained within the device 10 while the user is knitting. The device 10 stabilizes the user's hand and wrist 20 and prevents fingertip and wrist soreness caused by knitting.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

We claim:

1. A finger protecting device comprising:

a band configured for positioning around a wrist of a user;

a pair of finger guards, each of said finger guards having a top edge and a perimeter wall extending downwardly from said top edge, each of said top edges and said perimeter walls defining an interior space of said finger guards wherein said finger guards are configured for positioning over a thumb and an index finger of the user, said finger guards comprising a first finger guard and a second finger guard wherein said first finger guard is configured for positioning over a thumb of the user and said second finger guard is configured for positioning over an index finger of the user, a distance between said top edge and said bottom edge of said first finger guard being smaller than a distance between said top edge and said bottom edge of said second finger guard;

a bottom edge of each of said finger guards defining an access opening into said interior space of said finger guards; and a pair of straps, each said strap coupling said band to an associated one of said finger guards.

2. The device of claim 1, further comprising said band having a top side, a bottom side, and a peripheral wall extending between said top side and said bottom side.

3. The device of claim 2, further comprising said straps extending outwardly from said top side of said band.

4. The device of claim 1, further comprising said band being comprised of an elastomeric material.

5. The device of claim 1, further comprising said finger guards being comprised of a resiliently compressible material wherein said finger guards are stretchable.

6. The device of claim 1, further comprising a distance between lateral sides of said first finger guard being greater than a distance between lateral sides of said second finger guard.

7. The device of claim 1, further comprising said top edges of said finger guards being arcuate.

8. The device of claim 1, further comprising a plurality of raised bumps being positioned on said finger guards.

9. The device of claim 8, further comprising said raised bumps being positioned on an exterior surface of said finger guards.

10. The device of claim 9, further comprising said raised bumps being spaced and positioned uniformly across said exterior surface of said finger guards between said top and bottom edges of each of an associated one of said finger guards.

11. The device of claim 8, further comprising said raised bumps being comprised of a resiliently compressible material wherein said raised bumps are configured to facilitate gripping.

12. The device of claim 1, further comprising an inner surface of said finger guards being lined with a first material, said first material being fleece fabric.

13. The device of claim 1, further comprising said straps being comprised of an elastomeric material.

14. The device of claim 1, further comprising each of said straps having a first end and a second end, said first ends of said straps being coupled to a lower edge of said band, said second ends of said straps being coupled to said bottom edge of an associated one of said finger guards.

15. The device of claim 1, further comprising said straps abutting each other at an inner edge of each of said straps and extending away from each other to form a v-shape when said band is worn on the user's wrist and the user's thumb and index finger are positioned in said finger guards.

16. The device of claim 1, further comprising said strap coupling said band to said first finger guard being shorter in length than said strap coupling said band to said second finger guard.

17. The device of claim 1, further comprising each of said finger guards being concavely arcuate between an associated one of said top and bottom edges.

18. A finger protecting device comprising:

a band having a top side, a bottom side, and a peripheral wall extending between said top side and said bottom side, said band being comprised of an elastomeric material, said band being configured for positioning around a wrist of a user;

a pair of finger guards, said finger guards being comprised of a resiliently compressible material wherein said finger guards are stretchable, each of said finger guards having a top edge and a perimeter wall extending downwardly from said top edge, each of said top edges and said perimeter walls defining an interior space of said finger guards, said finger guards comprising a first finger guard and a second finger guard wherein said first finger guard is configured for positioning over a thumb of the user and said second finger guard is configured for positioning over an index finger of the user, a distance between lateral sides of said first finger guard being greater than a distance between lateral sides of said second finger guard, said top edges of said finger guards being arcuate;

a bottom edge of each of said finger guards defining an access opening into said interior space of said finger guards;

a plurality of raised bumps being positioned on said finger guards, said raised bumps being positioned on an exterior surface of said finger guards, said raised bumps being spaced and positioned uniformly across said exterior surface of said finger guards between said top and bottom edges of each of an associated one of said finger guards, said raised bumps being comprised of a resiliently compressible material wherein said raised bumps are configured to facilitate gripping;

an inner surface of said finger guards being lined with a first material, said first material being a fleece fabric;

a pair of straps, each strap coupling said band to an associated one of said finger guards, said straps being comprised of an elastomeric material, said straps extending outwardly from said top side of said band, each of said straps having a first end and a second end, said first ends of said straps being coupled to a lower edge of said band, said second ends of said straps being coupled to said bottom edge of an associated one of said finger guards, said straps abutting each other at an inner edge of each of said straps and extending away from each other to form a v-shape when said band is worn on the user's wrist and the user's thumb and index finger are positioned in said finger guards, said strap coupling said band to said first finger guard being shorter in length than said strap coupling said band to said second finger guard;

wherein a distance between said top edge and said bottom edge of said first finger guard is smaller than a distance between said top edge and said bottom edge of said second finger guard; and wherein each of said finger guards is concavely arcuate between an associated one of said top and bottom edges.

* * * * *